United States Patent [19]

Zieg

[11] Patent Number: 4,505,456

[45] Date of Patent: Mar. 19, 1985

[54] RAILING AND BALUSTER CONNECTION

[75] Inventor: Steven A. Zieg, Anaheim Hills, Calif.

[73] Assignee: Mansion Industries, Inc., City of Industry, Calif.

[21] Appl. No.: 588,247

[22] Filed: Mar. 12, 1984

[51] Int. Cl.[3] ..... E04H 17/14

[52] U.S. Cl. ..... 256/67; 256/65; 403/84

[58] Field of Search ..... 256/67, 65, 59; 403/82, 403/84, 114

[56] References Cited

U.S. PATENT DOCUMENTS

| | | | |
|---|---|---|---|
| 263,324 | 8/1882 | Devoe . | |
| 3,004,751 | 10/1961 | Woodward | 256/67 |
| 3,306,586 | 2/1967 | Green . | |
| 4,138,094 | 2/1979 | Thir . | |
| 4,272,061 | 6/1981 | Suckno . | |
| 4,408,749 | 10/1983 | Zieg . | |
| 4,421,302 | 12/1983 | Grimm | 256/65 X |

FOREIGN PATENT DOCUMENTS 2837060 11/1979 Fed. Rep. of Germany .

*Primary Examiner*—Andrew V. Kundrat
*Attorney, Agent, or Firm*—William W. Haefliger

[57] ABSTRACT

For combination with a rail having an elongated recess sunk in one lateral side thereof and also having at least one interior socket laterally intersecting the recess, the socket having an interior laterally facing wall defined by the rail, the socket also having a generally cylindrically curved interior wall, and an elongated moulding received in the recess and attached to the rail to laterally block the recess the improvement comprising (a) a baluster having a pivot at an end thereof, the pivot receivable in said socket for pivoting therein, (b) the pivot having generally parallel, laterally spaced opposite sides, (c) the pivot having first and second wall sections which are spaced apart and extend generally cylindrically in matching curved relation to the curvature of the socket wall, portions of the sections remaining in the socket during pivoting of the baluster, (d) the pivot also having a third wall section which intersects the first and second wall sections and which is spaced inwardly from a cylindrical locus forming a continuation of said first and second wall sections, whereby the third wall section remains in the socket during baluster pivoting.

12 Claims, 9 Drawing Figures

RAILING AND BALUSTER CONNECTION

BACKGROUND OF THE INVENTION

This invention relates generally to rail and baluster systems, and more particularly concerns improvements in systems wherein balusters and rails are angularly adjustable after their assembly, to fit the different pitches of stairways.

Conventional installation of balusters and rails is undesirably time consuming as respects cutting balusters to proper angle and length, attaching them to the rails, and filling in the gaps with fillet pieces which must also be cut to length and angle and attached. Due to this conventional installation difficulty, pre-assembled systems have been developed which do not require cutting of balusters, but do require cutting and installation of fillets.

Such current variable pitch systems must be attached to the supporting newel posts while in a pre-assembled condition. This not only is heavy, but is bulky and requires a two-man installation team.

U.S. Pat. No. 4,408,749 discloses an adjustable rail and baluster system which overcomes many of such problems.

SUMMARY OF THE INVENTION

It is a major object of the present invention to improve the construction of balusters as usable in the system disclosed in U.S. Pat. No. 4,408,749, and the connection of the balusters to the rail or rails. It is also an object of the invention to provide an unusually advantageous method of forming such balusters, particularly their pivots.

Basically, the improved baluster of the invention is usable in combination with a rail having an elongated recess sunk in one lateral side thereof and also having at least one interior socket laterally intersecting said recess, the socket having an interior laterally facing wall defined by the rail, the socket also having a generally cylindrically curved interior wall, and an elongated moulding received in said recess and attached to the rail to laterally block said recess. In this environment the baluster of the invention has a pivot at an end thereof, the pivot receivable in the socket for pivoting therein; the pivot has generally parallel, laterally spaced, opposite sides; and the pivot also has first and second wall sections which are spaced apart and extend generally cylindrically in matching curved relation to the curvature of said socket wall, portions of the sections remaining in the socket during pivoting of the baluster; further the pivot also has a third wall section which intersects said first and second wall sections and which is spaced inwardly from a cylindrical locus forming a continuation of said first and second wall sections, whereby said third wall section remains in said socket during baluster pivoting It is another object of the invention to provide, in combination with the improved structure as described above, improved rail and moulding elements which define elongated, divergent and laterally spaced flanges forming a zone therebetween to laterally cover or mask a baluster pivot partly located in the socket, and protruding therefrom.

A further object of the invention is to provide an improved method of constructing or forming the baluster, as described, and as will appear herein.

These and other objects and advantages of the invention, as well as the details of an illustrative embodiment, will be more fully understood from the following specification and drawings, in which:

DRAWING DESCRIPTION

DETAILED DESCRIPTION

Figure 8:
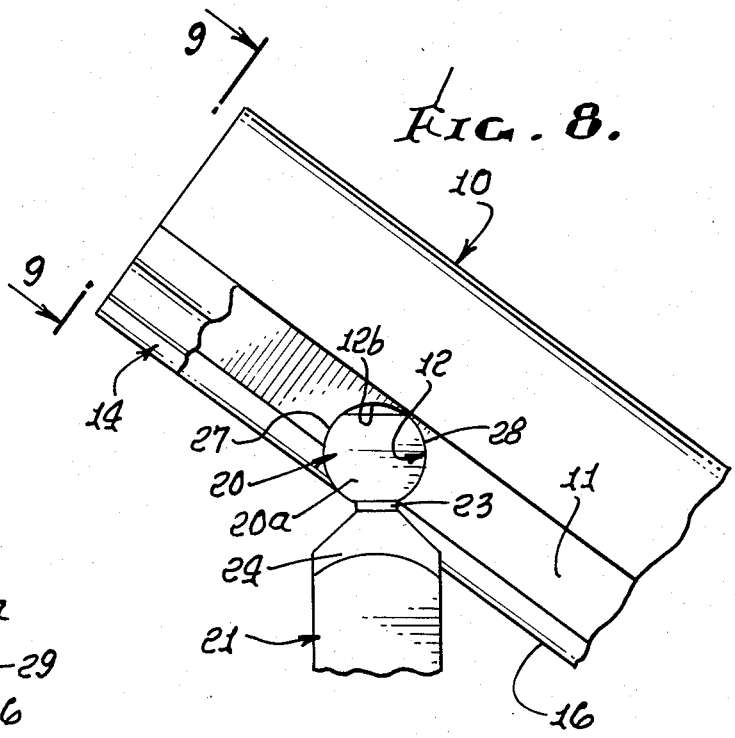
FIG. 8 is a side elevation showing installation of the FIG. 4 baluster end portion in a rail socket.
Figure 9:
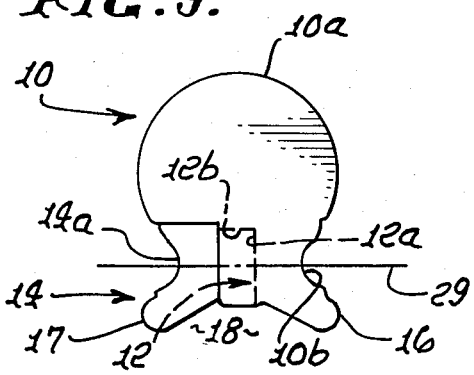
FIG. 9 is an end view on lines 9—9 of FIG. 8.

Referring first to FIGS. 8 and 9, the invention is adapted for combination or use with a rail 10 having an elongated recess 11 sunk in one lateral side thereof. The rail also has at least one, and typically a number of interior sockets 12 sunk in a recess interior wall to laterally intersect the recess. Each socket has an interior wall 12*a* defined by the rail, as well as a generally cylindrically curved interior wall 12*b* extending about and facing a laterally extending central axis 29 defined by the socket. The rail is shown as convexly curved or rounded at 10*a*. An elongated moulding 14 is received in the recess and suitably attached to the rail, as by adhesive. The rail and moulding are inwardly concave and narrowed at loci 10*b* and 14*a*, at opposite sides of the sockets as viewed in FIG. 9; also the rail and moulding define elongated and laterally spaced flanges 16 and 17, which are downwardly divergent in FIG. 9 to form a zone 18 therebetween to laterally cover or mask a baluster pivot 20 partly located in the socket 12, and partly protruding therefrom as at 20*a* in FIG. 8.

An important improvement provided by the invention is embodied in the pivot 20 at one end of the baluster 21, the pivot receivable laterally in the socket prior to attachment of the molding, for pivoting therein.

Figure 3:
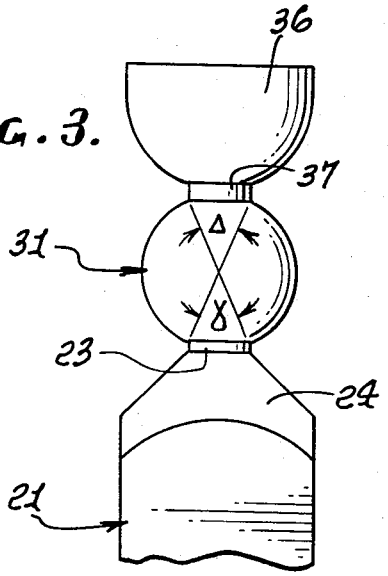
FIG. 3 is an enlarged elevation showing a baluster end portion after turning but before further processing.
Figure 5:
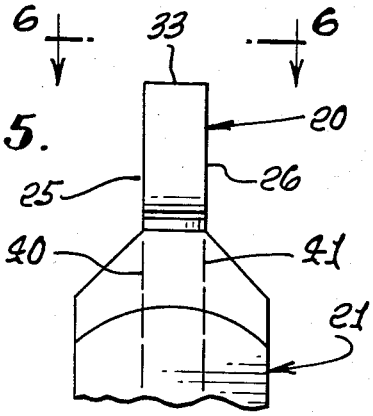
FIG. 5 is a view on lines 5—5 of FIG. 4.
Figure 6:
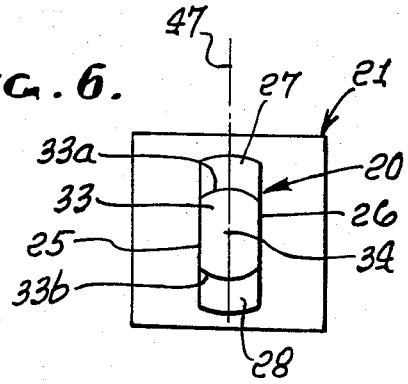
FIG. 6 is a top plan view on lines 6—6 of FIG. 5.

It will be noted that the pivot is locally attached at 23 to the baluster tapered neck 24. Connection 23 subtends an angle between 30° and 45°, as shown. The pivot has generally parallel, laterally spaced opposite sides 25 and 26, as shown in FIGS. 5 and 6; also, it has first and second wall sections 27 and 28 which are spaced apart and extend generally cylindrically (i.e. as cylindrical sectors) in matching curved relation to the curvature of the socket interior wall 12*b*, so that the pivot, when first inserted, is free to adjustably pivot in the socket generally about the socket axis 29. Portions of the sections 27 and 28 always remain in the socket during such pivoting, whereas a portion of section 27 (for example) protrudes from the socket in finally adjusted position of the baluster relative to the rail, as seen in FIG. 8. The surfaces of sections 27 and 28 are crowned (see FIG. 6), and preferably define surface portions of a single sphere or ball (see ball 31 in FIG. 3, prior to processing of the baluster).

Figure 4:
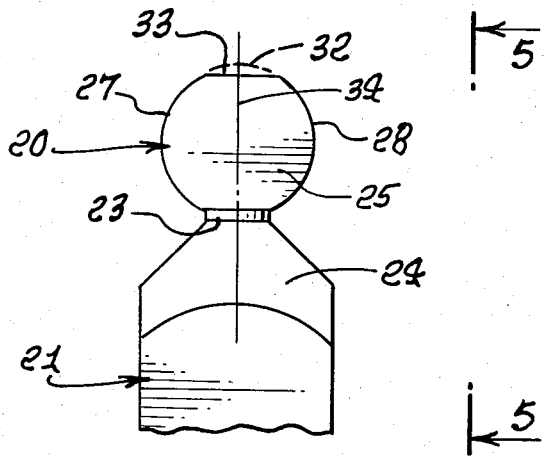
FIG. 4 is a view like FIG. 3, showing the baluster end portion after processing.

The pivot also has a third wall section which intersects the two wall sections 27 and 28, and which is spaced inward from a cylindrical locus (see locus 32 in FIG. 4) that forms a continuation of the first and second wall sections 27 and 28. As shown, the third wall section 33 extends generally chordwise and flatly between sections 27 and 28, whereby it always remains in the socket during baluster adjustment pivoting through an angle less than about 45°. Note that wall section 33 lies diametrically opposite the baluster neck connection 23 to the pivot. The intersections of the wall section 33 with wall sections 27 and 28 are along curved lines **33*a* and 33*b* which are concave toward baluster lengthwise axis 34. Also, wall sections 27, 28 and 33 intersect the laterally spaced flat opposite sides 25 and 26 of the pivot. The maximum length of flat 33 between lines 33*a* and 33*b*** is less than the ball diameter.

Figure 2:
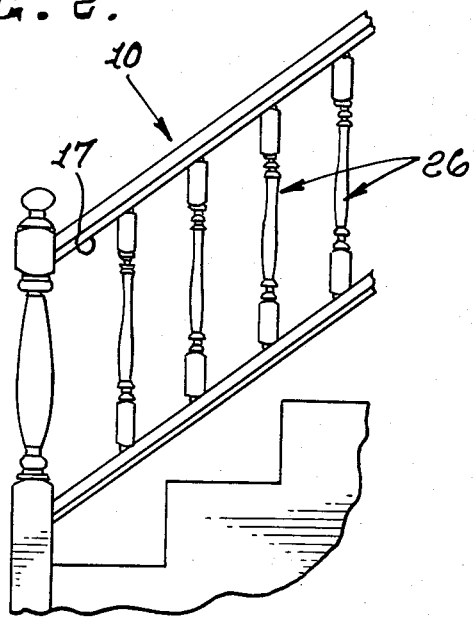
FIG. 2 is a view of a stairway, with balusters and rails.
Figure 1:
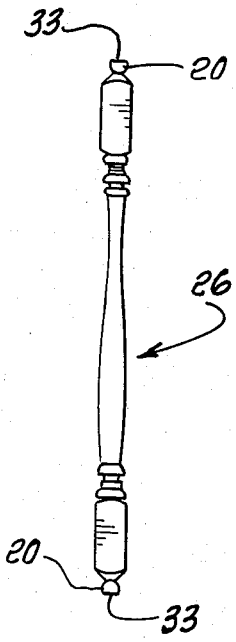
FIG. 1 is an elevation showing a baluster.

FIG. 2 shows multiple balusters 26 attached to a rail 10, via pivots as described. Note that moulding flange 17 laterally covers the extents of the pivots that protrude from the sockets.

Figure 7:
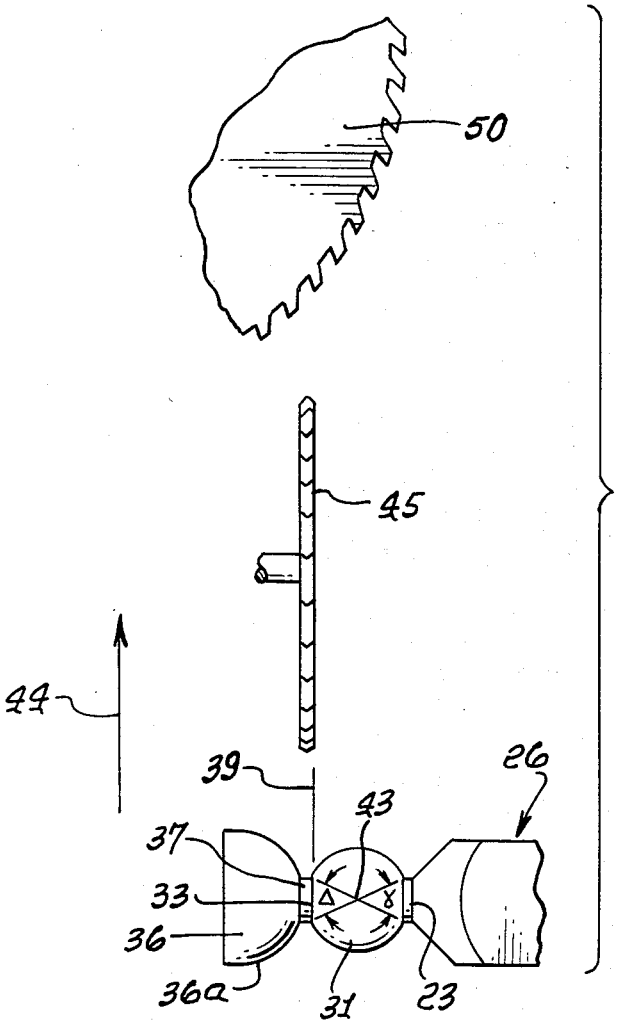
FIG. 7 is a schematic showing of processing of the baluster end portion.

FIG. 7 shows an unusually advantageous method for forming the pivot 20. The precursor baluster 26 shown in FIGS. 3 and 7 form ball 31 and a ball extension 36 at an end of the baluster. These are formed by turning the baluster, the neck connection 37 of extension 36 to ball 31 having about the same diameter as the neck connection 23 previously described. This facilitates turning of the ball 31 to have neck connection subtended angles $\gamma$ and $\Delta$ each between 30° and 45°, so that adjustment pivoting of the pivot in the socket, as described, is realized. Ball 31 has a radius slightly less than the radius defined by the socket cylindrically curved inner wall **12*b*** or approximately equal to that radius, to rotate with slight friction.

Next, the ball extension 36 is cut from the main extent of ball 31 along a cutting path 39 passing through the ball and spaced from the ball center 43 generally toward extension 36. For this purpose, the baluster is relatively moved in the direction of arrow 44 in FIG. 7, to cause rotating blade 45 to cut the flat 33, tangent with or to plane 39.

Next, the ball 31 is cut along laterally spaced planes (see planes 40 and 41 in FIG. 5) which are generally parallel to the length dimension of the baluster. The baluster is relatively displaced in arrow direction 44 to cause two rotating blades 50 to cut the flats 25 and 26. As seen in FIG. 5, planes 40 and 41 are equally spaced from and at opposite sides of a central plane 47 bisecting the baluster (see FIG. 6).

Accordingly, all surfaces of the pivot are produced or formed quickly and accurately. Extension 36 is first used as a support to enable turning (cutting) of the ball 31 and turning of the extension 36 to have the cupped exterior surface **36*a* as shown, to form connection 37**, which is then severed as described.

All parts are typically wooden.

I claim:

1. For combination with a rail having an elongated recess sunk in one lateral side thereof and also having at least one interior socket laterally intersecting said recess, the socket having an interior laterally facing wall defined by the rail, the socket also having a generally cylindrically curved interior wall, and an elongated moulding received in said recess and attached to the rail to laterally block said recess, the improvement comprising (a) a baluster having a pivot at an end thereof, the pivot receivable in said socket for pivoting therein, (b) the pivot having generally parallel, laterally spaced opposite sides, (c) the pivot having first and second wall sections which are spaced apart and extend generally cylindrically in matching curved relation to the curvature of said socket wall, portions of said sections remaining in the socket during pivoting of the baluster, (d) the pivot also having a third wall section which intersects said first and second wall sections and which is spaced inwardly from a cylindrical locus forming a continuation of said first and second wall sections, whereby said third wall section remains in said socket during baluster pivoting

2. The improvement of claim 1 wherein said third wall section extends generally chordwise and flatly between said first and second wall sections.

3. The improvement of claim 1 wherein the surfaces of said first and second wall sections are crowned.

4. The improvement of claim 3 wherein said crowned surfaces defined surface portions of a single sphere.

5. The improvement of claim 3 wherein said first, second and third wall sections intersect said laterally spaced opposite sides of the pivot.

6. The improvement of claim 1 wherein the socket defines a lateral axis about which said socket inner wall extends, cylindrically, and about which said first and second wall sections of the pivot extend, generally cylindrically.

7. The improvement of one of claims 1–6 including said rail and moulding defining elongated, divergent and laterally spaced flanges forming a zone therebetween to laterally cover or mask a baluster pivot partly located in said socket and protruding therefrom.

8. The combination that comprises a rail, and multiple sockets and pivots on balusters as defined in claim 1, said sockets and pivots spaced apart along the rail length.

9. The method of forming a pivot adapted for pivoted reception in a socket formed in an elongated rail to laterally intersect an elongated recess sunk in one lateral side of the rail, the socket having an interior laterally facing wall defined by the rail, and having a generally cylindrically curved interior wall, there being a moulding received in said recess and attached to the rail to laterally block the recess, said method including:

(a) providing an elongated baluster forming a ball and a ball extension at an end of the baluster, the ball having a radius slightly less than a radius defined by said socket cylindrically curved interior wall, (b) and cutting said ball extension from the main extent of the ball along a cutting path passing through the ball and spaced from the center of the ball generally toward said extension, (c) cutting the ball along laterally spaced planes generally parallel to the length dimension of the baluster and spaced apart at opposite sides of a central plane bisecting said baluster and at a width between said planes less than the socket width, (d) whereby said pivot fits within and freely pivots within the socket.

10. The method of claim 9 wherein said cutting of said ball extension is carried out to define a planar cutting path, of a maximum length less than the ball diameter.

11. The method of claim 9 including forming said socket in said rail to retain said pivot therein and to limit pivoting of the socket within the recess to an angle less than about 45°.

12. The improvement of claim 2 wherein said third wall section has like, arcuately curved ends the maximum distance therebetween being less than the maximum distance between said first and second wall sections (a) measured through a central axis defined by the pivot, said ends subtending an angle from said axis of between 30° and 45°.

* * * * *